US012187397B2

(12) United States Patent
Ikegaya

(10) Patent No.: US 12,187,397 B2
(45) Date of Patent: Jan. 7, 2025

(54) SYSTEM FOR AND METHOD OF CONTROLLING WATERCRAFT

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 379 days.

(21) Appl. No.: 17/518,674

(22) Filed: Nov. 4, 2021

(65) Prior Publication Data

US 2022/0169353 A1 Jun. 2, 2022

(30) Foreign Application Priority Data

Nov. 27, 2020 (JP) ..... 2020-197454

(51) Int. Cl.

| | |
|---|---|
| ***B63H 20/12*** | (2006.01) |
| ***B63B 79/10*** | (2020.01) |
| ***B63B 79/40*** | (2020.01) |
| ***B63H 25/46*** | (2006.01) |

(52) U.S. Cl.

CPC ..... *B63H 20/12* (2013.01); *B63B 79/10* (2020.01); *B63B 79/40* (2020.01); *B63H 25/46* (2013.01)

(58) Field of Classification Search

CPC ..... B63H 20/12; B63H 25/46; B63B 79/10; B63B 79/40

See application file for complete search history.

(56) References Cited

U.S. PATENT DOCUMENTS

| | | | | |
|---|---|---|---|---|
| 2006/0105647 | A1* | 5/2006 | Yazaki | B63H 21/213 440/53 |
| 2014/0309931 | A1 | 10/2014 | Ohmori et al. | |
| 2018/0057131 | A1* | 3/2018 | Steward | B63H 20/12 |
| 2018/0286251 | A1* | 10/2018 | Fujima | G05D 1/0206 |
| 2019/0204085 | A1* | 7/2019 | Kikuchi | G01C 21/20 |
| 2020/0247516 | A1* | 8/2020 | Lammers-Meis | B63H 25/52 |

FOREIGN PATENT DOCUMENTS

| | | | |
|---|---|---|---|
| JP | 2014024421 A | * | 2/2014 |
| JP | 2014-206452 A | | 10/2014 |

* cited by examiner

*Primary Examiner* — Ramsey Refai
*Assistant Examiner* — Roy Rhee
(74) *Attorney, Agent, or Firm* — Keating & Bennett, LLP

(57) ABSTRACT

A controller for a marine propulsion device determines a route on which a single or a plurality of target spots are located. The controller controls the marine propulsion device such that a watercraft moves along the route. The controller obtains a position of the watercraft, and determines whether or not the watercraft has arrived at a destination. When it is determined that the watercraft has arrived at the destination, the controller controls the marine propulsion device in a fixed spot keeping mode to keep the watercraft located at the destination.

18 Claims, 12 Drawing Sheets

SYSTEM FOR AND METHOD OF CONTROLLING WATERCRAFT

CROSS REFERENCE TO RELATED APPLICATIONS

This application claims the benefit of priority to Japanese Patent Application No. 2020-197454 filed on Nov. 27, 2020. The entire contents of this application are hereby incorporated herein by reference.

BACKGROUND OF THE INVENTION

1. Field of the Invention

The present invention relates to a system for and a method of controlling a watercraft.

2. Description of the Related Art

There has been conventionally known a technology of automatically controlling a watercraft to pass through one or more target spots specified by a user. For example, a system described in Japan Laid-open Patent Application Publication No. 2014-206452 includes a marine propulsion device, a position sensor, an input device, and a controller. A user specifies one or more target spots with the input device. The controller determines a route on which the one or more target spots are located. While detecting a position of the watercraft, the controller controls the marine propulsion device such that the watercraft moves along the route.

Also, there has been conventionally known a fixed spot keeping mode for keeping a watercraft located in a predetermined position as a type of automated control for watercraft. In the fixed spot keeping mode, the marine propulsion device is controlled to keep the watercraft located in, for instance, a position where the watercraft was located in starting the fixed spot keeping mode.

In the system described above, when the watercraft arrives at a destination, the controller ends the route tracking type of automated control for the watercraft. However, chances are that keeping the watercraft located at the destination is desirable for a user. In this case, the user can automatically keep the watercraft located at the destination by starting the fixed spot keeping mode. However, when the position of the watercraft is displaced from the destination when starting the fixed spot keeping mode due to factors such as the flow of the water or wind, the watercraft is inevitably kept located in the position displaced from the destination in the fixed spot keeping mode. Because of this, the user is required to manually modify the position of the watercraft. Thus, there is still room for improvement.

SUMMARY OF THE INVENTION

Preferred embodiments of the present invention provide systems and methods, each of which enables a watercraft to be moved under automated control and accurately maintained at a destination with a simple operation.

A system according to a preferred embodiment of the present invention controls a watercraft and includes a marine propulsion device, a position sensor, an input, and a controller. The position sensor detects a position of the watercraft. The input is manually operable, and outputs an operating signal indicating a single or a plurality of target spots inputted thereto. The single or the plurality of target spots include a destination. The controller receives the operating signal, and determines a route on which the single or the plurality of target spots are located. The controller controls the marine propulsion device such that the watercraft moves along the route, and obtains the position of the watercraft. The controller determines whether or not the watercraft has arrived at the destination, and controls the marine propulsion device in a fixed spot keeping mode to keep the watercraft located at the destination when it is determined that the watercraft has arrived at the destination.

A method according to another preferred embodiment of the present invention controls a watercraft including a marine propulsion device and includes receiving an operating signal indicating a single or a plurality of target spots that are to be inputted and include a destination, determining a route on which the single or the plurality of target spots are located, controlling the marine propulsion device such that the watercraft moves along the route, obtaining a position of the watercraft, determining whether or not the watercraft has arrived at the destination, and controlling the marine propulsion device in a fixed spot keeping mode to keep the watercraft located at the destination when it is determined that the watercraft has arrived at the destination.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
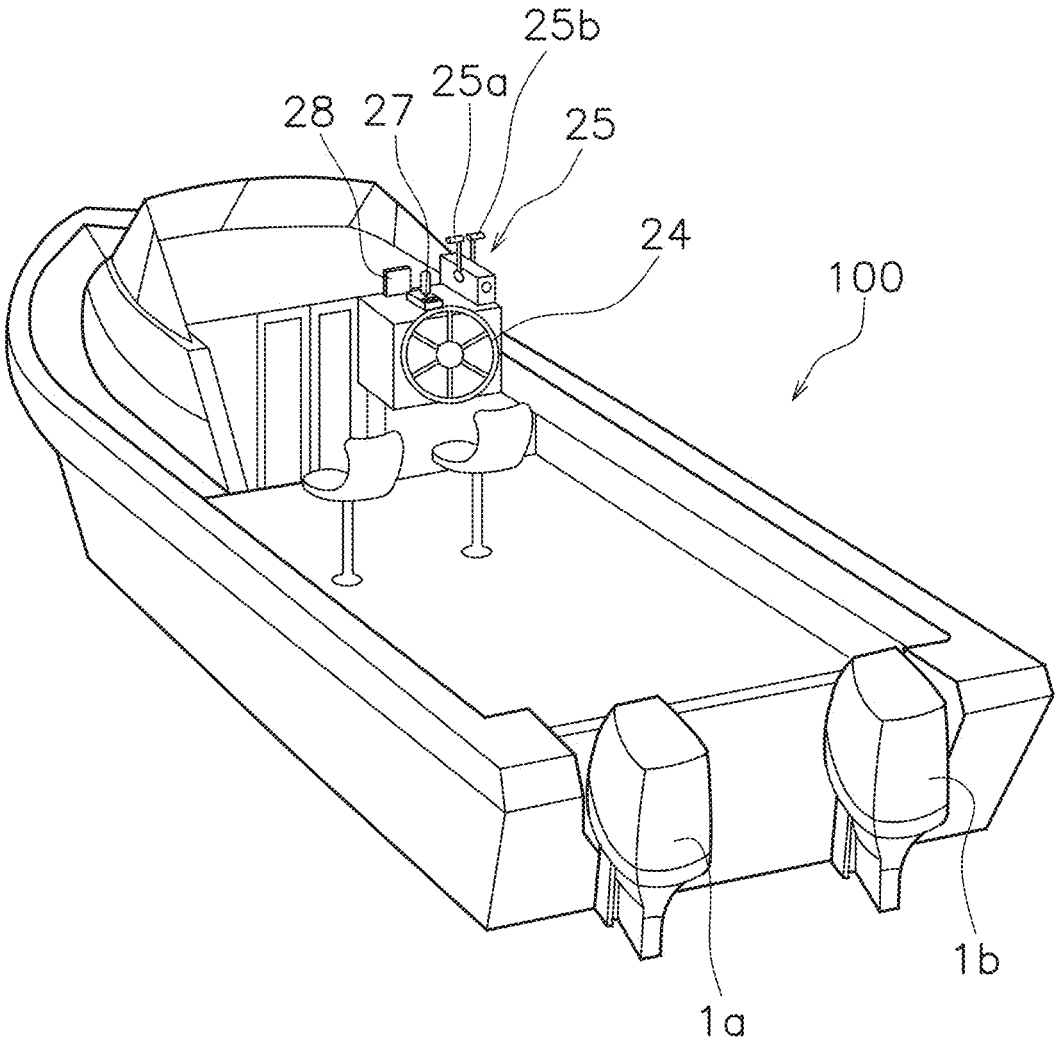
FIG. 1 is a perspective view of a watercraft to which marine propulsion devices according to a preferred embodiment of the present invention are mounted.

Preferred embodiments of the present invention will be hereinafter explained with reference to drawings. FIG. 1 is a perspective view of a watercraft 100 to which marine propulsion devices 1*a* and 1*b* according to a preferred embodiment of the present invention are mounted. The marine propulsion devices 1*a* and 1*b* are mounted to the watercraft 100. In the present preferred embodiment, the marine propulsion devices 1*a* and 1*b* are outboard motors. The marine propulsion devices 1*a* and 1*b* are attached to the stern of the watercraft 100. The marine propulsion devices 1*a* and 1*b* are aligned in a width direction of the watercraft 100. Specifically, the marine propulsion device 1*a* is located on the port side of the watercraft 100, and the marine propulsion device 1*b* is located on the starboard side of the watercraft 100. Each marine propulsion device 1*a*, 1*b* generates a thrust to propel the watercraft 100.

Figure 2:
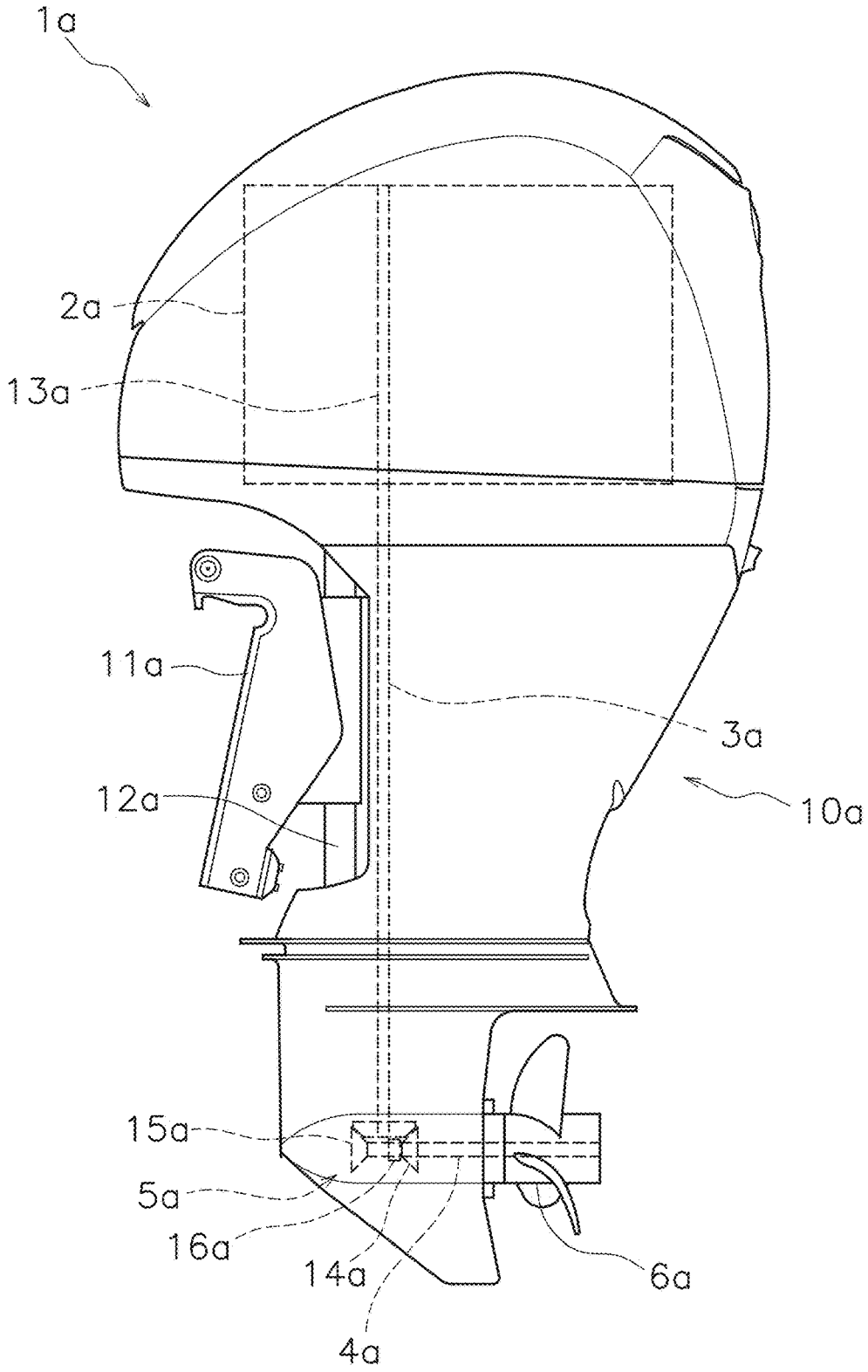
FIG. 2 is a side view of one of the marine propulsion devices.

FIG. 2 is a side view of the marine propulsion device 1*a*. The structure of the marine propulsion device 1*a* will be hereinafter explained. However, the structure of the marine propulsion device 1*a* also applies to the marine propulsion device 1*b*. The marine propulsion device 1*a* is attached to the watercraft 100 through a bracket 11*a*. The bracket 11*a* supports the marine propulsion device 1*a* such that the marine propulsion device 1*a* is rotatable about a steering shaft 12*a*. The steering shaft 12*a* extends in an up-and-down direction of the marine propulsion device 1*a*.

The marine propulsion device 1*a* includes a drive unit 2*a*, a drive shaft 3*a*, a propeller shaft 4*a*, a shift mechanism 5*a*, and a housing 10*a*. The drive unit 2*a* generates the thrust to propel the watercraft 100. The drive unit 2*a* is an internal combustion engine, for example. The drive unit 2*a* includes a crankshaft 13*a*. The crankshaft 13*a* extends in the up-and-down direction of the marine propulsion device 1*a*. The drive shaft 3*a* is connected to the crankshaft 13*a*. The drive shaft 3*a* extends in the up-and-down direction of the marine propulsion device 1*a*. The propeller shaft 4*a* extends in a back-and-forth direction of the marine propulsion device 1*a*. The propeller shaft 4*a* is connected to the drive shaft 3*a* through the shift mechanism 5*a*. A propeller 6*a* is attached to the propeller shaft 4*a*.

The shift mechanism 5*a* includes a forward moving gear 14*a*, a rearward moving gear 15*a*, and a dog clutch 16*a*. When gear engagement of each gear 14*a*, 15*a* is switched by the dog clutch 16*a*, the shift mechanism 5*a* is switched among a forward moving state, a rearward moving state, and a neutral state. When set in the forward moving state, the shift mechanism 5*a* transmits rotation, directed to move the watercraft 100 forward, from the drive shaft 3*a* to the propeller shaft 4*a*. When set in the rearward moving state, the shift mechanism 5*a* transmits rotation, directed to move the watercraft 100 rearward, from the drive shaft 3*a* to the propeller shaft 4*a*. When set in the neutral state, the shift mechanism 5*a* does not transmit rotation from the drive shaft 3*a* to the propeller shaft 4*a*. The housing 10*a* accommodates the drive unit 2*a*, the drive shaft 3*a*, the propeller shaft 4*a*, and the shift mechanism 5*a*.

Figure 3:
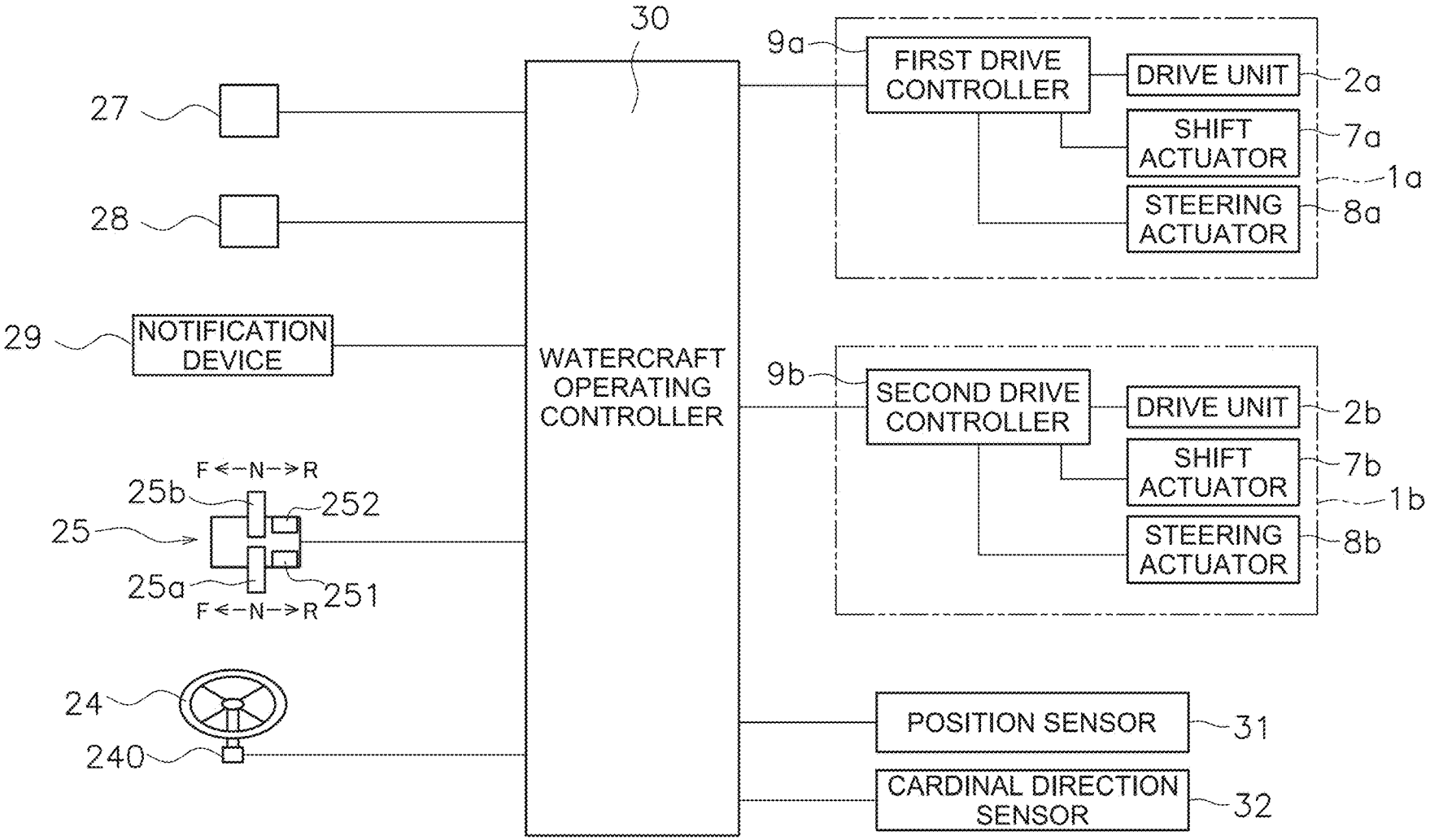
FIG. 3 is a schematic diagram showing a configuration of a watercraft operating system for the watercraft.

FIG. 3 is a schematic diagram showing a configuration of a watercraft operating system for the watercraft 100. As shown in FIG. 3, the marine propulsion device 1*a* includes a shift actuator 7*a* and a steering actuator 8*a*.

The shift actuator 7*a* is connected to the dog clutch 16*a* of the shift mechanism 5*a*. The shift actuator 7*a* actuates the dog clutch 16*a* to switch gear engagement of each gear 14*a*, 15*a*. In response, the shift mechanism 5*a* is switched among the forward moving state, the rearward moving state, and the neutral state. The shift actuator 7*a* is, for instance, an electric motor. However, the shift actuator 7*a* may be another type of actuator such as an electric cylinder, a hydraulic motor, or a hydraulic cylinder.

The steering actuator 8*a* is connected to the marine propulsion device 1*a*. The steering actuator 8*a* rotates the marine propulsion device 1*a* about the steering shaft 12*a*. Accordingly, the marine propulsion device 1*a* is changed in rudder angle. The rudder angle refers to an angle of the propeller shaft 4*a* with respect to the back-and-forth direction of the marine propulsion device 1*a*. The steering actuator 8*a* is, for instance, an electric motor. However, the steering actuator 8*a* may be another type of actuator such as an electric cylinder, a hydraulic motor, or a hydraulic cylinder.

The marine propulsion device 1*a* includes a first drive controller 9*a*. The first drive controller 9*a* includes a processor such as a CPU (Central Processing Unit) and memories such as a RAM (Random Access Memory) and a ROM (Read Only Memory). The first drive controller 9*a* stores a program and data to control the marine propulsion device 1*a*. The first drive controller 9*a* controls the drive unit 2*a*.

The marine propulsion device 1*b* includes a drive unit 2*b*, a shift actuator 7*b*, a steering actuator 8*b*, and a second drive controller 9*b*. The drive unit 2*b*, the shift actuator 7*b*, the steering actuator 8*b*, and the second drive controller 9*b* in the marine propulsion device 1*b* are configured in similar manner to the drive unit 2*a*, the shift actuator 7*a*, the steering actuator 8*a*, and the first drive controller 9*a* in the marine propulsion device 1*a*, respectively.

The watercraft operating system includes a steering wheel 24, an operating device 25, a first input device 27, a second input device 28, and a notification device 29. The steering wheel 24, the operating device 25, the first input device 27, the second input device 28, and the notification device 29 are located in a cockpit of the watercraft 100. The steering wheel 24, the operating device 25, the first input device 27, and the second input device 28 are manually operable.

The steering wheel 24 allows a user to turn the direction of the watercraft 100. The steering wheel 24 includes a sensor 240. The sensor 240 outputs a steering signal indicating an operating direction and an operating amount of the steering wheel 24.

The operating device 25 includes a first throttle lever 25*a* and a second throttle lever 25*b*. The first throttle lever 25*a* allows the user to regulate the magnitude of the thrust generated by the marine propulsion device 1*a*. The first throttle lever 25*a* also allows the user to switch the direction of the thrust generated by the marine propulsion device 1*a* between a forward moving direction and a rearward moving direction. The first throttle lever 25*a* is movable from a neutral position to a forward moving position and a rearward moving position. The neutral position is located between the forward moving position and the rearward moving position. The first throttle lever 25*a* includes a sensor 251. The sensor 251 outputs a throttle signal indicating an operating direction and an operating amount of the first throttle lever 25*a*.

The second throttle lever 25*b* allows the user to regulate the magnitude of the thrust generated by the marine propulsion device 1*b*. The second throttle lever 25*b* also allows the user to switch the direction of the thrust generated by the marine propulsion device 1*b* between the forward moving direction and the rearward moving direction. The second throttle lever 25*b* is configured in similar manner to the first throttle lever 25*a*. The second throttle lever 25*b* includes a sensor 252. The sensor 252 outputs a throttle signal indicating an operating direction and an operating amount of the second throttle lever 25*b*.

The watercraft operating system includes a watercraft operating controller 30. The watercraft operating controller 30 includes a processor such as a CPU and memories such as a RAM and a ROM. The watercraft operating controller 30 stores programs and data to control the marine propulsion devices 1*a* and 1*b*. The watercraft operating controller 30 is connected to the first and second drive controllers 9*a* and 9*b* through wired or wireless communication. The watercraft operating controller 30 is connected to the steering wheel 24, the operating device 25, the first input device 27, the second input device 28, and the notification device 29 through wired or wireless communication.

The watercraft operating controller 30 receives the steering signal from the sensor 240. The watercraft operating controller 30 receives the throttle signals from the sensors 251 and 252. The watercraft operating controller 30 outputs command signals to the first and second drive controllers 9*a* and 9*b* based on the signals received from the sensors 240, 251, and 252. The command signal is transmitted to the shift actuator 7*a* and the steering actuator 8*a* through the first drive controller 9*a*. The command signal is transmitted to the shift actuator 7*b* and the steering actuator 8*b* through the second drive controller 9*b*.

For example, the watercraft operating controller 30 outputs a command signal for the shift actuator 7*a* in accordance with the operating direction of the first throttle lever 25*a*. In response, shifting between forward movement and rearward movement by the marine propulsion device 1*a* is performed. The watercraft operating controller 30 outputs a throttle command for the drive unit 2*a* in accordance with the operating amount of the first throttle lever 25*a*. The first drive controller 9*a* controls an output rotational speed of the marine propulsion device 1*a* in accordance with the throttle command.

The watercraft operating controller 30 outputs a command signal for the shift actuator 7*b* in accordance with the operating direction of the second throttle lever 25*b*. In response, shifting between forward movement and rearward movement by the marine propulsion device 1*b* is performed. The watercraft operating controller 30 outputs a throttle command for the drive unit 2*b* in accordance with the operating amount of the second throttle lever 25*b*. The second drive controller 9*b* controls an output rotational speed of the marine propulsion device 1*b* in accordance with the throttle command.

The watercraft operating controller 30 outputs command signals for the steering actuators 8*a* and 8*b* in accordance with the operating direction and the operating amount of the steering wheel 24. When the steering wheel 24 is rotated leftward from the neutral position, the watercraft operating controller 30 controls the steering actuators 8*a* and 8*b* such that the marine propulsion devices 1*a* and 1*b* are rotated rightward. The watercraft 100 thus turns leftward.

When the steering wheel 24 is rotated rightward from the neutral position, the watercraft operating controller 30 controls the steering actuators 8*a* and 8*b* such that the marine propulsion devices 1*a* and 1*b* are rotated leftward. The watercraft 100 thus turns rightward. Additionally, the watercraft operating controller 30 controls the rudder angles of the marine propulsion devices 1*a* and 1*b* depending on the operating amount of the steering wheel 24.

The watercraft operating system includes a position sensor 31. The position sensor 31 detects a position of the watercraft 100. The position sensor 31 is, for example, a GNSS (Global Navigation Satellite System) receiver such as a GPS (Global Positioning System) receiver. However, the position sensor 31 may be a type of sensor other than the GNSS receiver. The position sensor 31 outputs a signal indicating the position of the watercraft 100. The watercraft operating controller 30 is connected to the position sensor 31 in a communicable manner. The watercraft operating controller 30 obtains the position of the watercraft 100 based on the signal received from the position sensor 31. Additionally, the watercraft operating controller 30 obtains a velocity of the watercraft 100 based on the signal received from the position sensor 31. The watercraft operating system may include another type of sensor to detect the velocity of the watercraft 100.

The watercraft operating system includes a cardinal direction sensor 32. The cardinal direction sensor 32 detects a course of the watercraft 100. The cardinal direction sensor 32 is, for instance, an IMU (Inertial Measurement Unit). However, the cardinal direction sensor 32 may be a type of sensor other than the IMU. The watercraft operating controller 30 is connected to the cardinal direction sensor 32 in a communicable manner. The watercraft operating controller 30 obtains the course of the watercraft 100 based on a signal received from the cardinal direction sensor 32.

The notification device 29 notifies information in accordance with the command signal received from the watercraft operating controller 30. For example, the notification device 29 includes a speaker and outputs a notification sound therefrom. Alternatively, the notification device 29 may include a display and may display a notification image thereon. Yet alternatively, the notification device 29 may include a lamp to notify information and may light up the lamp.

The first input device 27 is operable by the user to select one of a plurality of control modes of each marine propulsion device 1*a*, 1*b*. The first input device 27 may be provided on a watercraft operating device such as a joystick. Alternatively, the first input device 27 may be provided at a position separate from the watercraft operating device. The first input device 27 includes at least one switch to select one of the control modes. The first input device 27 may not necessarily include the at least one switch, and alternatively, may include another type of device such as a touchscreen. The first input device 27 outputs a command signal indicating the control mode selected by the user. The watercraft operating controller 30 receives the command signal from the first input device 27. The watercraft operating controller 30 executes an automated watercraft control for the watercraft 100 in accordance with the selected control mode. The watercraft operating controller 30 controls the marine propulsion devices 1*a* and 1*b* in the automated watercraft control such that the watercraft 100 moves in accordance with the selected control mode.

In the automated watercraft control, the watercraft operating controller 30 causes each marine propulsion device 1*a*, 1*b* to generate a thrust oriented in the forward moving direction by controlling each drive unit 2*a*, 2*b* and each shift actuator 7*a*, 7*b*. The watercraft 100 thus moves forward. In the automated watercraft control, the watercraft operating controller 30 alternatively causes each marine propulsion device 1*a*, 1*b* to generate a thrust oriented in the rearward moving direction by controlling each drive unit 2*a*, 2*b* and each shift actuator 7*a*, 7*b*. The watercraft 100 thus moves rearward. In the automated watercraft control, the watercraft operating controller 30 changes the rudder angle of each marine propulsion device 1*a*, 1*b* by controlling each steering actuator 8*a*, 8*b*. The watercraft 100 thus turns right and left.

Figure 4:
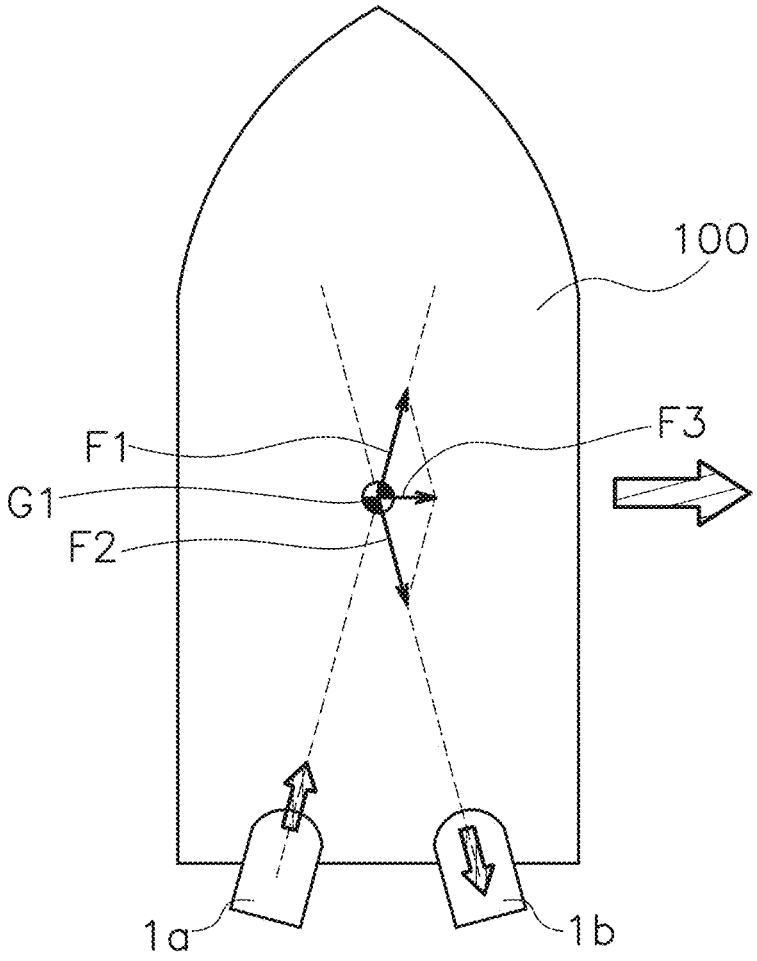
FIG. 4 is a schematic diagram showing controls of the marine propulsion devices.

As shown in FIG. 4, in the automated watercraft control, the watercraft operating controller 30 controls the thrust and the rudder angle of each marine propulsion device 1*a*, 1*b* such that a net thrust (F3) of the thrust (F1) of the marine propulsion device 1*a* and the thrust (F2) of the marine propulsion device 1*b* is oriented sideways, while extending through the center of gravity (G1) of the watercraft 100. The watercraft 100 thus performs a translational motion in a sideways direction. In the automated watercraft control, the watercraft operating controller 30 alternatively causes one of the marine propulsion devices 1*a* and 1*b* to generate a thrust oriented in the forward moving direction, while causing the other to generate a thrust oriented in the rearward moving direction. The watercraft 100 thus performs a bow turning motion.

The second input device 28 is operable by the user to perform a control mode setting. The second input device 28 is, for instance, a touchscreen. The second input device 28 is not limited to the touchscreen, and alternatively, may include another type of device such as at least one switch. The watercraft operating system may include a display separate from the second input device 28. The second input device 28 outputs an operating signal indicating the setting of the control mode selected by the user. The watercraft operating controller 30 receives the operating signal from the second input device 28.

Figure 5:
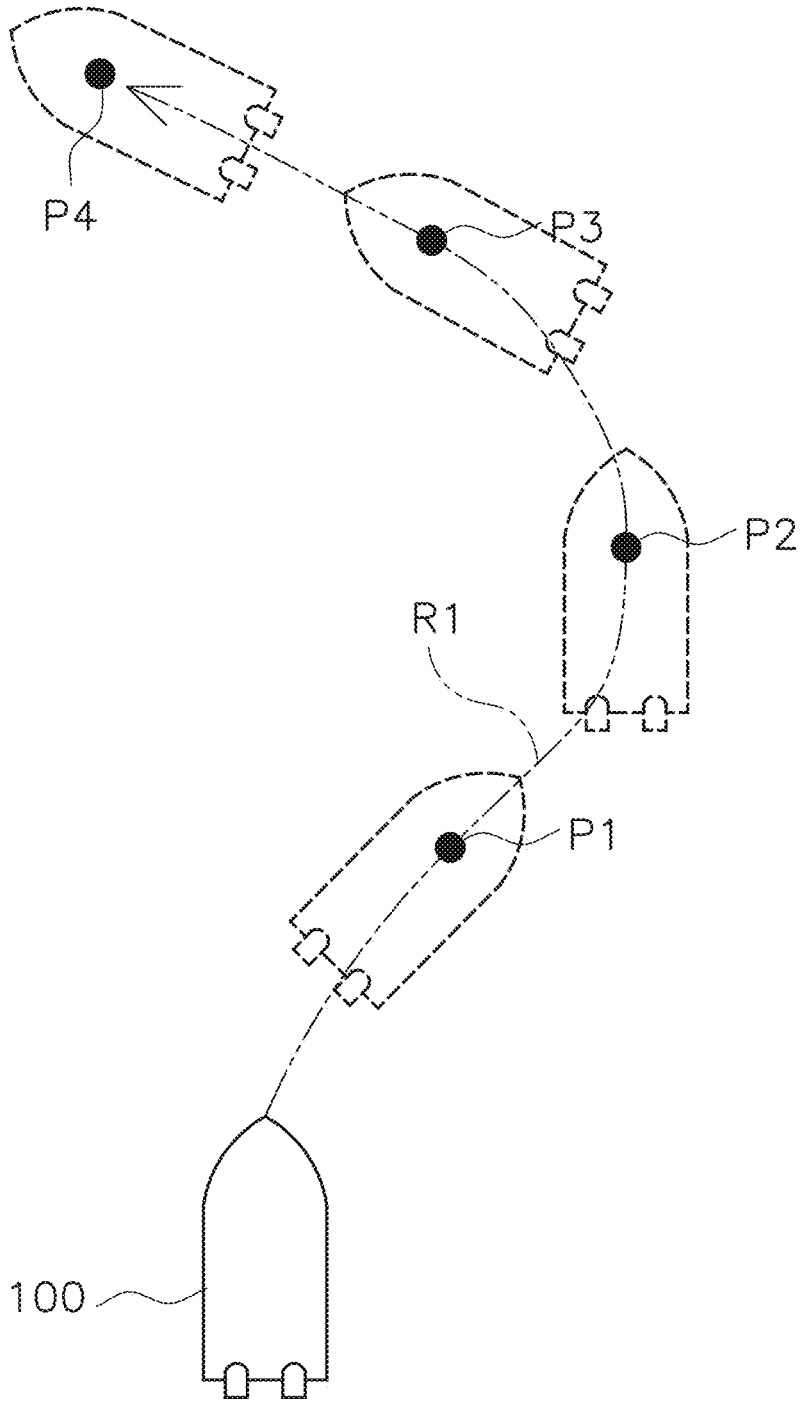
FIG. 5 is a diagram showing a series of motions performed by the watercraft in a track point mode.

The control modes include a track point mode and a fixed spot keeping mode. As shown in FIG. 5, in the track point mode, the watercraft operating controller 30 controls the marine propulsion devices 1*a* and 1*b* such that the watercraft 100 moves along a route R1. The user sets the route R1 with the second input device 28. More specifically, the user specifies a plurality of target spots P1 to P4, including the target spot P4 as a destination, with the second input device 28. For example, the user arbitrarily selects the target spots P1 to P4 on a map displayed on the second input device 28. The second input device 28 outputs an operating signal indicating the selected plural target spots P1 to P4. The number of target spots may be one. The watercraft operating controller 30 computes the route R1 on which the target spots P1 to P4 are located. The watercraft operating controller 30 controls the marine propulsion devices 1*a* and 1*b* such that the watercraft 100 moves along the route R1.

Figure 6:
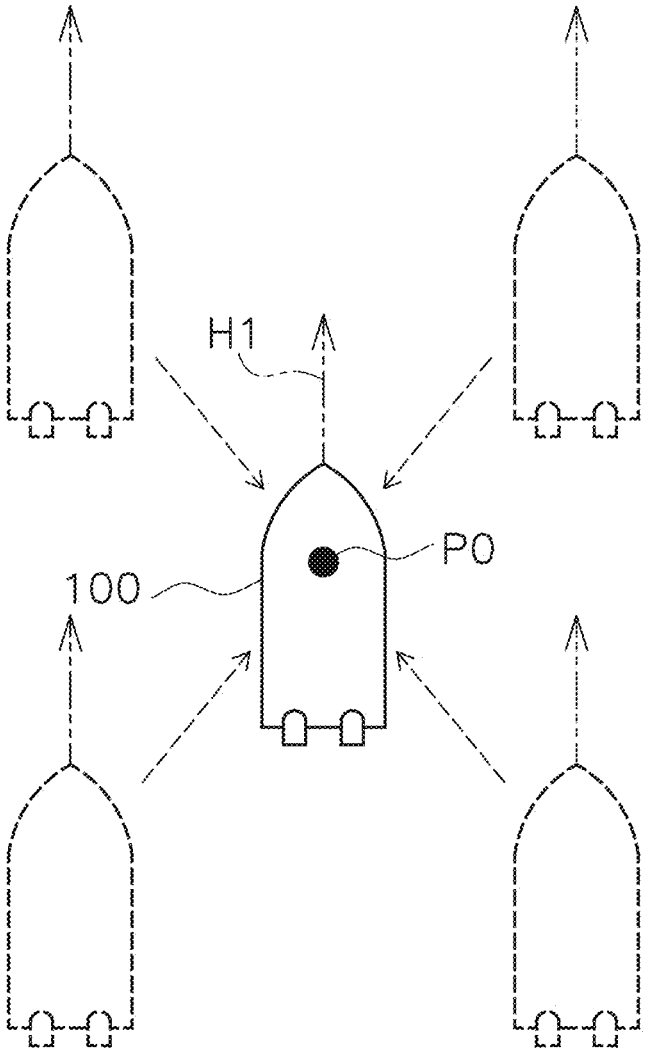
FIG. 6 is a diagram showing a variety of motions performed by the watercraft in a fixed spot keeping mode.

As shown in FIG. 6, in the fixed spot keeping mode, the watercraft operating controller 30 keeps the watercraft 100 located at a set position P0, while the bow of the watercraft 100 is kept oriented in a target cardinal direction H1. For example, the watercraft operating controller 30 determines, as the target cardinal direction H1, a cardinal direction in which the watercraft 100 is oriented when selecting the fixed spot keeping mode with the first input device 27. The watercraft operating controller 30 determines, as the set position P0, a position in which the watercraft 100 is located when selecting the fixed spot keeping mode with the first input device 27. The watercraft operating controller 30 controls the thrust and the rudder angle of each marine propulsion device 1*a*, 1*b* such that the watercraft 100 is kept in the set position, while the bow thereof is kept oriented in the target cardinal direction H1.

Figure 7:
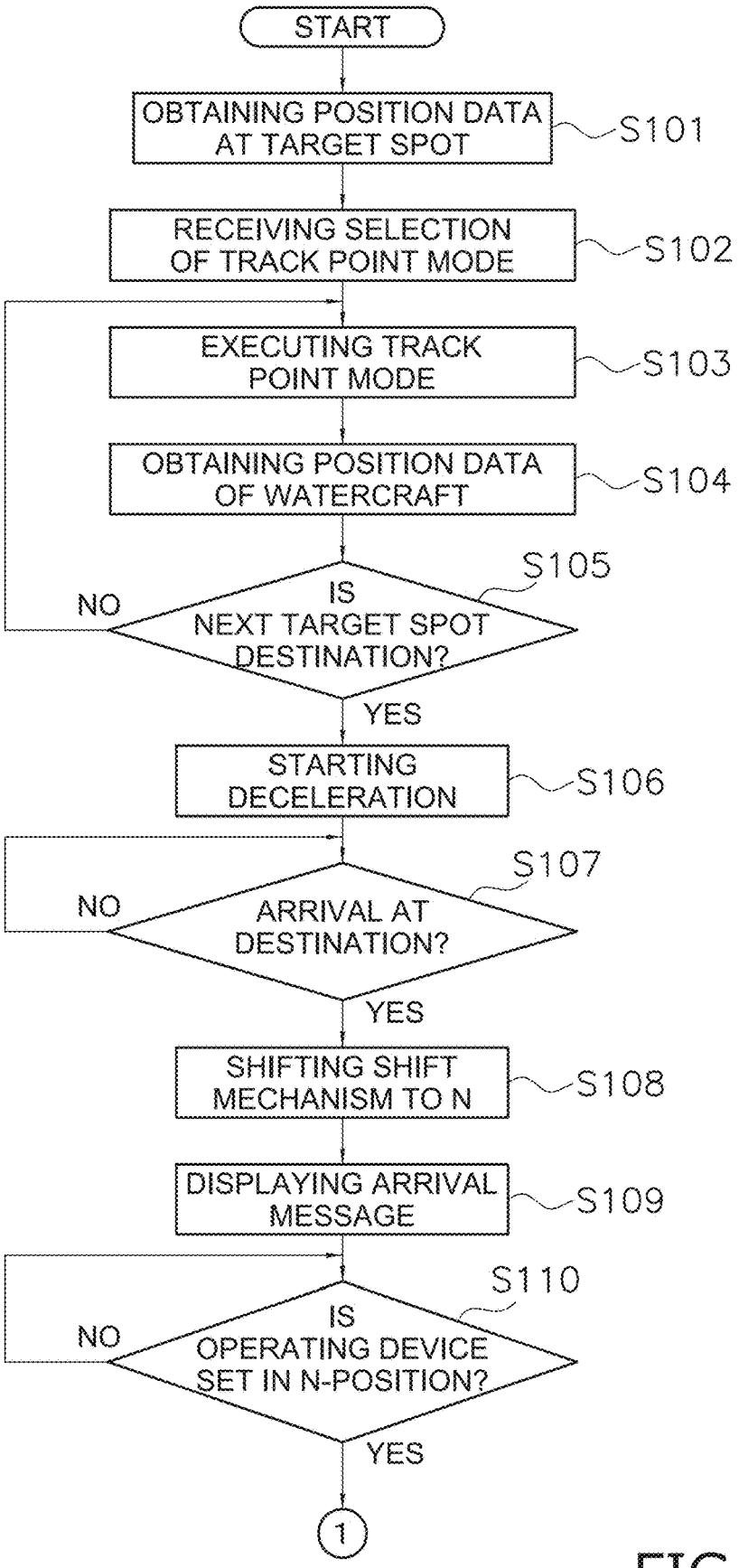
FIG. 7 is a flowchart showing a portion of a series of processes executed when starting and ending the track point mode.
Figure 8:
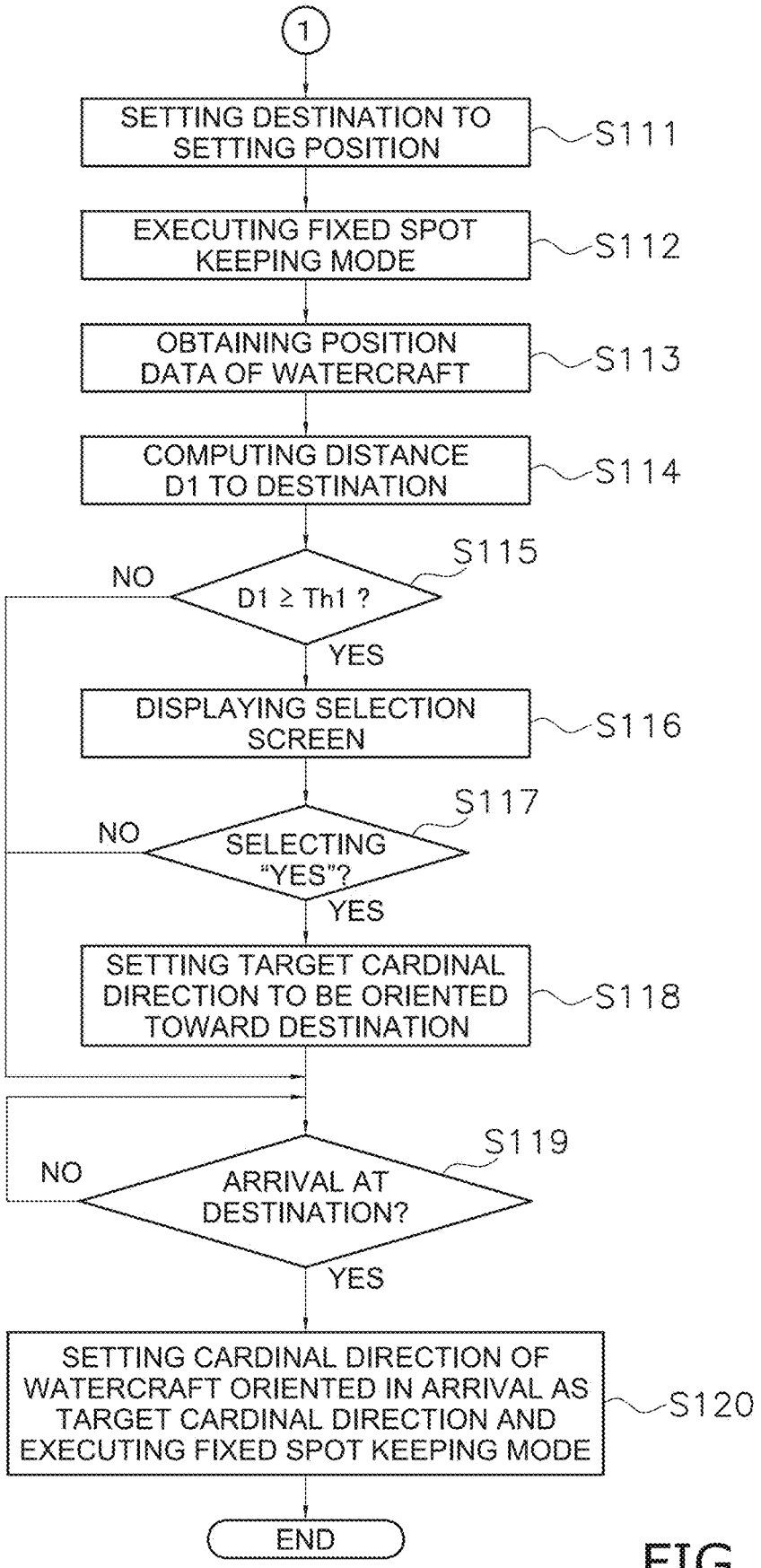
FIG. 8 is a flowchart showing another portion of the series of processes executed when starting and ending the track point mode.
Figure 9:
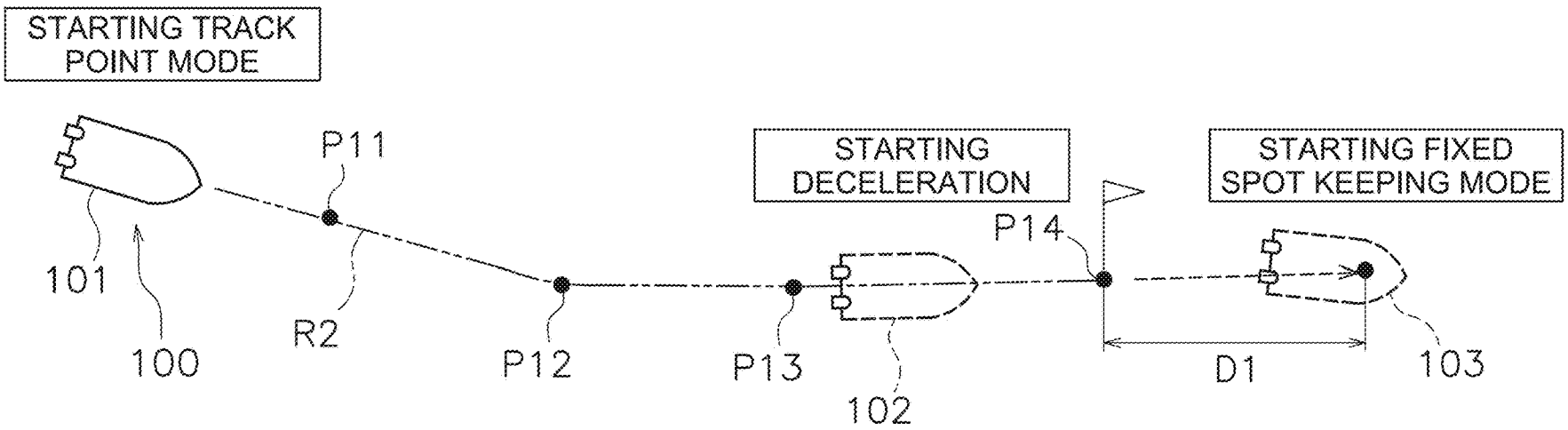
FIG. 9 is a diagram exemplifying a series of motions performed by the watercraft when starting and ending the track point mode.
Figure 10:
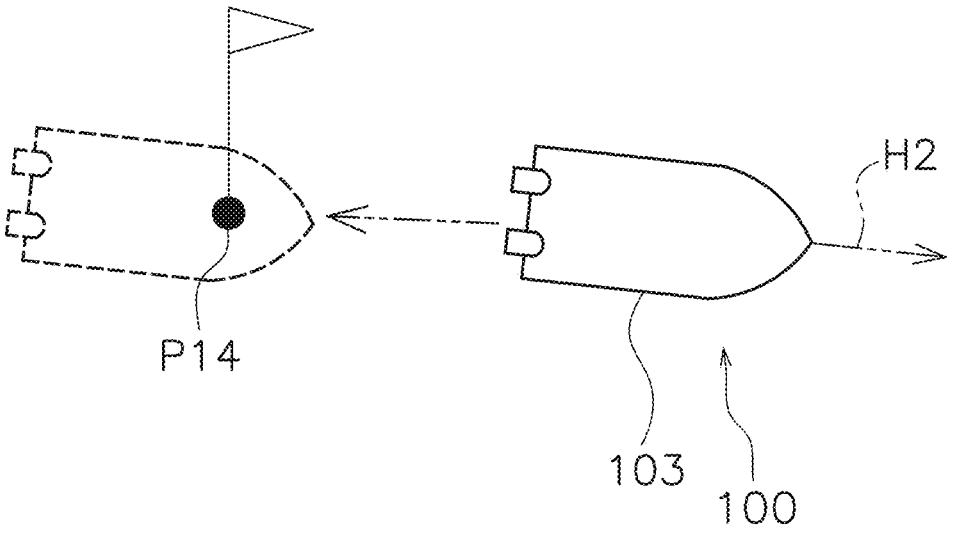
FIG. 10 is a diagram exemplifying portion of the series of motions performed by the watercraft when starting and ending the track point mode.
Figure 11:
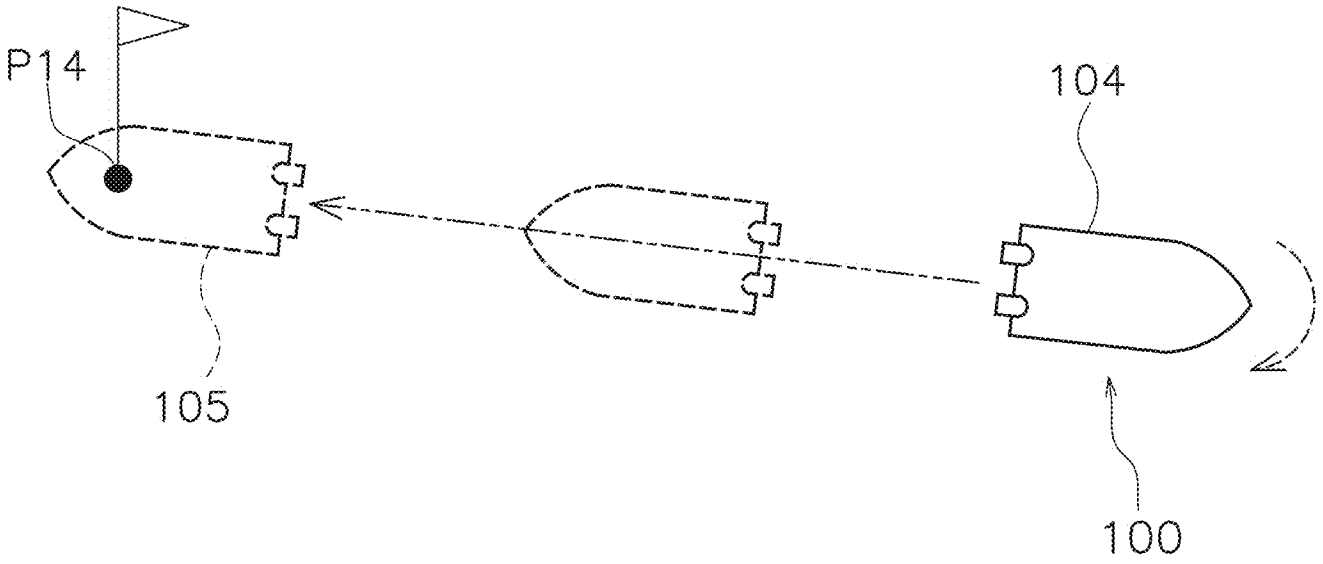
FIG. 11 is a diagram exemplifying another portion of the series of motions performed by the watercraft when starting and ending the track point mode.

Next, a series of processes executed when the watercraft 100 arrives at the destination in the track point mode will be explained in detail. FIGS. 7 and 8 are flowcharts showing the series of processes executed when starting and ending the track point mode. FIGS. 9 to 11 are diagrams exemplifying a series of motions performed by the watercraft 100.

As shown in FIG. 7, in step S101, the watercraft operating controller 30 obtains position data of the target spots. The position data of the target spots indicate positions of the target spots. The target spots include a destination. The watercraft operating controller 30 obtains the position data of the target spots based on the signal received from the second input device 28. For example, as shown in FIG. 9, the watercraft operating controller 30 obtains the position data of target spots P11 to P14 including a destination P14. In step S102, the watercraft operating controller 30 receives a selection of the track point mode. The watercraft operating controller 30 receives the selection of the track point mode based on the signal received from the first input device 27.

In step S103, the watercraft operating controller 30 executes the track point mode. The watercraft operating controller 30 sets a route, on which the target spots are located, based on the position data of the target spots. When the operating device 25 is moved to the forward moving position, the watercraft operating controller 30 causes the watercraft 100 to start moving along the set route. When the first and second throttle levers 25*a* and 25*b* are both moved to the forward moving positions, the watercraft operating controller 30 causes the watercraft 100 to start moving along the set route. For example, as shown in FIG. 9, the watercraft operating controller 30 sets a route R2 to a destination P14 via target spots P11-P13. The watercraft operating controller 30 starts the track point mode in a position 101 shown in FIG. 9. The watercraft operating controller 30 moves the watercraft 100 along the set route R2.

In step S104, the watercraft operating controller 30 obtains position data of the watercraft 100. The position data of the watercraft 100 indicates a position in which the watercraft 100 is located at the present time. The watercraft operating controller 30 obtains the position data of the watercraft 100 based on the signal received from the position sensor 31. In step S105, the watercraft operating controller 30 determines whether or not the next target spot is the destination. The watercraft operating controller 30 determines whether or not the next target spot is the destination based on the position data of the watercraft 100. For example, the watercraft operating controller 30 determines that the next target spot is the destination when a distance from the present position of the watercraft 100 to the destination P14 is less than or equal to a predetermined threshold. When the next target spot is the destination, the process proceeds to step S106.

In step S106, the watercraft operating controller 30 starts decelerating the watercraft 100. The watercraft operating controller 30 decelerates the watercraft 100 by reducing the thrust of each marine propulsion device 1*a*, 1*b*. For example, as shown in FIG. 9, when the watercraft 100 reaches a position 102, a distance from the watercraft 100 to the destination P14 becomes less than or equal to the predetermined threshold. The watercraft operating controller 30 decelerates the watercraft 100 when and after the watercraft 100 reaches the position 102. In step S107, the watercraft operating controller 30 determines whether or not the watercraft 100 has arrived at the destination P14. When the watercraft 100 has arrived at the destination P14, the process proceeds to step S108.

In step S108, the watercraft operating controller 30 switches the shift mechanism of each marine propulsion device 1*a*, 1*b* into the neutral state. In step S109, the watercraft operating controller 30 displays a message of arrival on the second input device 28. The message of arrival includes instructing the user to restore the operating device 25 to the neutral position. In step S110, the watercraft operating controller 30 determines whether or not the operating device 25 has been restored to the neutral position. When the first and second throttle levers 25*a* and 25*b* are both restored to the neutral positions, the watercraft operating controller 30 determines that the operating device 25 has been restored to the neutral position. When the operating device 25 has been restored to the neutral position, the process proceeds to step S111 shown in FIG. 8.

In step S111, the watercraft operating controller 30 sets the destination P14 as a set position. In step S112, the watercraft operating controller 30 executes the fixed spot keeping mode. The watercraft operating controller 30 controls the marine propulsion devices 1*a* and 1*b* such that the watercraft 100 is kept located at the destination P14. It should be noted that the watercraft operating controller 30 may cause the notification device 29 to output an image, sound, or so forth to notify information when starting the fixed spot keeping mode.

In step S113, the watercraft operating controller 30 obtains the position data of the watercraft 100. In step S114, the watercraft operating controller 30 computes a distance D1 to the destination P14 from a position in which the watercraft 100 is located at the present time. As shown in FIG. 9, it is possible that after arriving at the destination P14, the watercraft 100 may move away from the destination P14 and reach a position 103 located away from the destination P14 until the operating device 25 is restored to the neutral position. The watercraft operating controller 30 computes the distance D1 based the present position of the watercraft 100 and the location of the destination P14.

In step S115, the watercraft operating controller 30 determines whether or not the distance D1 is greater than or equal to a threshold Th1. The distance D1 is a distance at which the watercraft 100 is quickly returnable to the destination P14 in the fixed spot keeping mode. The threshold Th1 may be a fixed value. Alternatively, the threshold Th1 may be changeable by the user. When the distance D1 is less than the threshold Th1, the watercraft operating controller 30 moves the watercraft 100 to the destination P14 in the fixed spot keeping mode. For example, as shown in FIG. 10, the watercraft operating controller 30 controls the marine propulsion devices 1*a* and 1*b* such that the watercraft 100 moves to the destination P14, while the bow thereof is kept oriented in a target cardinal direction H2. For example, the target cardinal direction H2 is a cardinal direction in which the watercraft 100 is oriented when starting the fixed spot keeping mode. The target cardinal direction H2 may be changeable by the user.

Figure 12:
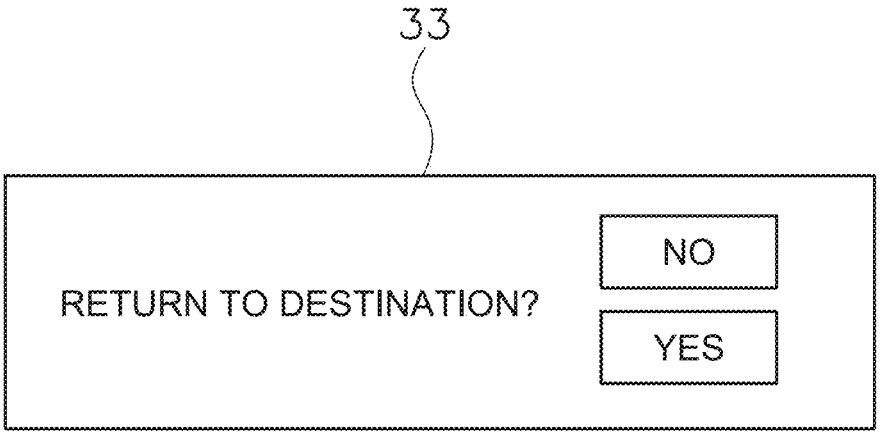
FIG. 12 is a diagram exemplifying a selection screen.

In step S115, when the distance D1 is greater than or equal to the threshold Th1, the process proceeds to step S116. In step S116, the watercraft operating controller 30 displays a selection screen 33 on the second input device 28. FIG. 12 exemplifies the selection screen 33. The selection screen 33 contains a representation for selecting whether or not the watercraft 100 returns to the destination P14. The watercraft operating controller 30 receives the selection made by the user on the selection screen 33 regarding whether or not the watercraft 100 returns to the destination P14. The watercraft operating controller 30 receives the selection made by the user through the signal received from the second input device 28.

In step S117, the watercraft operating controller 30 determines whether or not returning to the destination P14 has been selected. When returning to the destination P14 has not been selected, in other words, when "No" has been selected on the selection screen 33, the watercraft operating controller 30 moves the watercraft 100 to the destination P14 in the fixed spot keeping mode. In this case, as shown in FIG. 10, the watercraft operating controller 30 controls the marine propulsion devices 1*a* and 1*b* such that the watercraft 100 moves to the destination P14 while the bow thereof is kept oriented in the target cardinal direction H2. When returning to the destination P14 has been selected, in other words, when "Yes" has been selected on the selection screen 33, the process proceeds to step S118.

In step S118, the watercraft operating controller 30 sets a target cardinal direction oriented toward the destination P14. As shown in FIG. 11, the watercraft operating controller 30 turns the watercraft 100 such that the bow of the watercraft 100 is oriented toward the destination P14 in a position 104 that is a position of the watercraft 100 when selecting returning to the destination P14. Then, the watercraft operating controller 30 controls the marine propulsion devices 1*a* and 1*b* such that the watercraft 100 moves to the destination P14.

In step S119, the watercraft operating controller 30 determines whether or not the watercraft 100 has arrived at the destination P14. When the watercraft 100 has arrived at the destination P14 as indicated by a position 105 in FIG. 11, the process proceeds to step S120. In step S120, the watercraft operating controller 30 executes the fixed spot keeping mode by setting, as a target cardinal direction, a cardinal direction in which the watercraft 100 is oriented when arriving at the destination P14. The watercraft 100 is thus kept located at the destination P14.

In the watercraft operating system according to the present preferred embodiment explained above, the marine propulsion devices 1*a* and 1*b* are controlled such that the watercraft 100 moves along the route set in the track point mode. When it is then determined that the watercraft 100 has arrived at the destination P14, the marine propulsion devices 1*a* and 1*b* are controlled in the fixed spot keeping mode by setting the destination P14 as the set position. Therefore, when the watercraft 100 has arrived at the destination P14, the route tracking type of automated control is switched into the fixed spot keeping mode in which the watercraft 100 is kept located at the destination P14. Thus, the watercraft 100 is accurately kept located at the destination P14 with a simple operation.

Preferred embodiments of the present invention have been explained above. However, the present invention is not limited to the preferred embodiments described above, and a variety of changes can be made without departing from the gist of the present invention.

Each marine propulsion device is not limited to the outboard motor, and alternatively, may be another type of propulsion device such as an inboard engine outboard drive or a jet propulsion device. The structure of each marine propulsion device is not limited to that in the preferred embodiments described above and may be changed. For example, the first drive unit 2*a* is not limited to the internal combustion engine, and alternatively, may be an electric motor. Yet alternatively, the first drive unit 2*a* may be a hybrid system of an internal combustion engine and an electric motor. The number of marine propulsion devices is not limited to two. The number of marine propulsion devices may be more than two.

The series of processes executed when starting and ending the track point mode are not limited to those in the preferred embodiments described above and may be changed. For example, the series of processes in the preferred embodiments described above may be omitted or changed in part. A single or a plurality of processing steps, different from the processing steps executed in the preferred embodiments described above, may be additionally executed. The order of executing the processing steps is not limited to that in the preferred embodiments described above and may be changed.

In the preferred embodiments described above, when the distance D1 from the watercraft 100 to the destination P14 is greater than or equal to the threshold Th1, a target cardinal direction oriented toward the destination P14 is set in response to the selection made by the user. However, the watercraft operating controller 30 may control the marine propulsion devices 1*a* and 1*b* such that the bow of the watercraft 100 is automatically oriented toward the destination P14 when the distance D1 from the watercraft 100 to the destination P14 is greater than or equal to the threshold Th1.

In the fixed spot keeping mode, the watercraft operating controller 30 may only keep the watercraft 100 located in the set position P0 without setting the target cardinal direction H1. The user may be allowed to decide whether or not the target cardinal direction H1 is set with the second input device 28. When the target cardinal direction H1 is not set in the fixed spot keeping mode, the watercraft operating controller 30 may set a target cardinal direction in step S118 described above such that the bow or the stern of the watercraft 100 is oriented toward the destination P14. The user may be allowed to select which of the bow and the stern of the watercraft 100 is oriented toward the destination P14.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for controlling a watercraft, the system comprising:

a marine propulsion device;

a position sensor to detect a position of the watercraft;

an input device that is manually operable to output an operating signal indicating a single or a plurality of target spots inputted to the input device, the single or the plurality of target spots including a destination; and a controller configured or programmed to:

receive the operating signal;

determine a route on which the single or the plurality of target spots are located;

control the marine propulsion device such that the watercraft moves along the route;

obtain the position of the watercraft;

determine whether or not the watercraft has arrived at the destination;

control the marine propulsion device in a fixed spot keeping mode to keep the watercraft located at the destination while a bow of the watercraft is kept oriented in a target cardinal direction when it is determined that the watercraft has arrived at the destination;

determine whether or not the watercraft is away from the destination at a predetermined distance or greater after the watercraft has arrived at the destination;

receive a selection made by a user regarding whether or not to return the watercraft to the destination when the watercraft is away from the destination at the predetermined distance or greater;

control the marine propulsion device such that the bow of the watercraft is oriented toward the destination when returning to the destination is selected; and control the marine propulsion device such that the watercraft moves to the destination while the bow is kept oriented in the target cardinal direction when returning to the destination is not selected.

2. The system according to claim 1, further comprising:

an operator that is manually operable between a neutral position and a forward moving position and to output a signal indicating to which position the operator has been moved to; wherein the controller is further configured or programmed to:

cause the watercraft to start moving along the route when the operator has been moved to the forward moving position; and start the fixed spot keeping mode when the watercraft has arrived at the destination and the operator has been moved to the neutral position.

3. The system according to claim 1, wherein the controller is further configured or programmed to:

control the marine propulsion device in the fixed spot keeping mode when the watercraft is not away from the destination at the predetermined distance or greater.

4. The system according to claim 1, further comprising:

a notifier; wherein the controller is further configured or programmed to cause the notifier to output a notification when starting the fixed spot keeping mode.

5. A method of controlling a watercraft including a marine propulsion device, the method comprising:

receiving an operating signal indicating a single or a plurality of target spots to be inputted, the single or the plurality of target spots including a destination;

determining a route on which the single or the plurality of target spots are located;

controlling the marine propulsion device such that the watercraft moves along the route;

obtaining a position of the watercraft;

determining whether or not the watercraft has arrived at the destination;

controlling the marine propulsion device in a fixed spot keeping mode to keep the watercraft located at the destination while keeping a bow of the watercraft oriented in a target cardinal direction when it is determined that the watercraft has arrived at the destination;

determining whether or not the watercraft is away from the destination at a predetermined distance or greater after the watercraft has arrived at the destination;

receiving a selection made by a user regarding whether or not to return the watercraft to the destination when the watercraft is away from the destination at the predetermined distance or greater;

controlling the marine propulsion device such that the bow of the watercraft is oriented toward the destination when returning to the destination is selected; and controlling the marine propulsion device such that the watercraft moves to the destination while the bow is kept oriented in the target cardinal direction when returning to the destination is not selected.

6. The method according to claim 5, further comprising:

controlling the marine propulsion device in the fixed spot keeping mode when the watercraft is not away from the destination at the predetermined distance or greater.

7. The method according to claim 5, further comprising:

causing a notifier to output a notification when starting the fixed spot keeping mode.

8. The method according to claim 5, further comprising:

receiving a signal from an operator manually operable between a neutral position and a forward moving position, the signal indicating to which position the operator has been moved;

causing the watercraft to start moving along the route when the operator has been moved to the forward moving position; and starting the fixed spot keeping mode when the watercraft has arrived at the destination and the operator has been moved to the neutral position.

9. A system for controlling a watercraft, the system comprising:

a marine propulsion device;

a position sensor to detect a position of the watercraft;

an input device that is manually operable to output an operating signal indicating a single or a plurality of target spots inputted to the input device, the single or the plurality of target spots including a destination; and a controller configured or programmed to:

receive the operating signal;

determine a route on which the single or the plurality of target spots are located;

control the marine propulsion device such that the watercraft moves along the route;

obtain the position of the watercraft;

determine whether or not the watercraft has arrived at the destination;

control the marine propulsion device in a fixed spot keeping mode to keep the watercraft located at the destination when it is determined that the watercraft has arrived at the destination;

determine whether or not the watercraft is away from the destination at a predetermined distance or greater after the watercraft has arrived at the destination; and control the marine propulsion device such that a stern of the watercraft is oriented toward the destination when the watercraft is away from the destination at the predetermined distance or greater.

10. The system according to claim 9, further comprising:

an operator that is manually operable between a neutral position and a forward moving position and to output a signal indicating to which position the operator has been moved to; wherein the controller is further configured or programmed to:

cause the watercraft to start moving along the route when the operator has been moved to the forward moving position; and start the fixed spot keeping mode when the watercraft has arrived at the destination and the operator has been moved to the neutral position.

11. The system according to claim 9, wherein the controller is further configured or programmed to:

receive a selection regarding whether or not to return to the destination when the watercraft is away from the destination at the predetermined distance or greater; and control the marine propulsion device such that the watercraft moves to the destination when it has been selected to return to the destination.

12. The system according to claim 9, wherein the controller is further configured or programmed to:

control the marine propulsion device in the fixed spot keeping mode such that the watercraft is kept at the destination, and kept oriented in a cardinal direction that the watercraft was oriented when starting the fixed spot keeping mode; and control the marine propulsion device in the fixed spot keeping mode when the watercraft is not away from the destination at the predetermined distance or greater.

13. The system according to claim 9, further comprising:

a notifier; wherein the controller is further configured or programmed to cause the notifier to output a notification when starting the fixed spot keeping mode.

14. A method of controlling a watercraft including a marine propulsion device, the method comprising:

receiving an operating signal indicating a single or a plurality of target spots to be inputted, the single or the plurality of target spots including a destination;

determining a route on which the single or the plurality of target spots are located;

controlling the marine propulsion device such that the watercraft moves along the route;

obtaining a position of the watercraft;

determining whether or not the watercraft has arrived at the destination;

controlling the marine propulsion device in a fixed spot keeping mode to keep the watercraft located at the destination when it is determined that the watercraft has arrived at the destination;

determining whether or not the watercraft is away from the destination at a predetermined distance or greater after the watercraft has arrived at the destination; and controlling the marine propulsion device such that a stern of the watercraft is oriented toward the destination when the watercraft is away from the destination at the predetermined distance or greater.

15. The method according to claim 14, further comprising:

receiving a signal from an operator manually operable between a neutral position and a forward moving position, the signal indicating to which position the operator has been moved;

causing the watercraft to start moving along the route when the operator has been moved to the forward moving position; and starting the fixed spot keeping mode when the watercraft has arrived at the destination and the operator has been moved to the neutral position.

16. The method according to claim 14, further comprising:

receiving a selection regarding whether or not to return to the destination when the watercraft is away from the destination at the predetermined distance or greater; and controlling the marine propulsion device such that the watercraft is moved to the destination when it has been selected to return to the destination.

17. The method according to claim 14, further comprising:

controlling the marine propulsion device in the fixed spot keeping mode such that the watercraft is kept at the destination, and kept oriented in a cardinal direction that the watercraft was oriented when starting the fixed spot keeping mode; and controlling the marine propulsion device in the fixed spot keeping mode when the watercraft is not away from the destination at the predetermined distance or greater.

18. The method according to claim 14, further comprising:

causing a notifier to output a notification when starting the fixed spot keeping mode.

* * * * *